US011098729B2

(12) United States Patent
Colletti et al.

(10) Patent No.: US 11,098,729 B2
(45) Date of Patent: Aug. 24, 2021

(54) GAS TURBINE WHEEL ASSEMBLY, METHOD OF MODIFYING A COMPRESSOR WHEEL, AND METHOD OF MOUNTING A BLADE TO A GAS TURBINE WHEEL

(71) Applicant: GENERAL ELECTRIC COMPANY, Schenectady, NY (US)

(72) Inventors: Andrew Joseph Colletti, Greenville, SC (US); Bryan Edward Williams, Greenville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 422 days.

(21) Appl. No.: 15/228,461

(22) Filed: Aug. 4, 2016

(65) Prior Publication Data

US 2018/0038381 A1 Feb. 8, 2018

(51) Int. Cl.
*F04D 29/32* (2006.01)
*F04D 19/00* (2006.01)
(Continued)

(52) U.S. Cl.
CPC ..... *F04D 29/322* (2013.01); *F01D 5/326* (2013.01); *F04D 19/002* (2013.01);
(Continued)

(58) Field of Classification Search
CPC .... F04D 29/322; F04D 29/329; F04D 29/325; F04D 29/34; F04D 19/002
See application file for complete search history.

(56) References Cited

U.S. PATENT DOCUMENTS 3,952,395 A * 4/1976 Crossman ..... F16L 55/13 29/402.16
4,812,107 A 3/1989 Barcella et al.
(Continued)

FOREIGN PATENT DOCUMENTS

JP 2012229639 A 11/2012

OTHER PUBLICATIONS

"New technique allows replacement of compressor blades in-situ", dated Aug. 11, 2011, 2 pages, available at http://www.ccj-online.com/replace-compressor-blades-in-situ/.
(Continued)

*Primary Examiner* — Richard A Edgar
*Assistant Examiner* — Aye S Htay
(74) *Attorney, Agent, or Firm* — McNees Wallace & Nurick LLC

(57) ABSTRACT

A method of modifying a compressor wheel includes forming a stake-receiving feature having a reconditioned surface on a radial face of an axial slot in a rim of the compressor wheel. The forming includes removing stake marks in the radial face. A gas turbine wheel assembly includes a gas turbine wheel rotatable about an axis of a turbine and blades. A radial face of an axial slot in the gas turbine wheel includes a stake-receiving feature having a reconditioned surface. Material displaced at the reconditioned surface by staking axially retains a blade in the axial slot. A method of mounting a blade to a gas turbine wheel includes staking the base of the blade in the axial slot by displacing material at a reconditioned surface of a stake-receiving feature on a radial face of the axial slot to axially retain the base of the blade in the axial slot.

20 Claims, 6 Drawing Sheets

(51) Int. Cl.
*F01D 5/32* (2006.01)
*F04D 29/64* (2006.01)

(52) U.S. Cl.
CPC ..... *F04D 29/644* (2013.01); *F05D 2230/10* (2013.01); *F05D 2230/80* (2013.01); *F05D 2260/36* (2013.01)

(56) References Cited

U.S. PATENT DOCUMENTS 5,980,204 A 11/1999 Chevrette
6,158,961 A 12/2000 Kehl et al.
6,219,916 B1 4/2001 Walker et al.
6,666,653 B1 12/2003 Carrier
7,594,799 B2 9/2009 Miller et al.
8,061,995 B2 11/2011 Prince et al.
8,601,689 B2 12/2013 Hathiwala et al.
8,727,733 B2 5/2014 Thermos et al.
8,899,919 B2 12/2014 Heinzelmaier et al.
8,992,180 B2 3/2015 Agaram et al.
9,103,221 B2 8/2015 Torkaman et al.
2008/0267781 A1* 10/2008 Becker ..... F01D 5/326 416/220 R
2009/0077795 A1* 3/2009 Prince ..... F01D 5/323 29/700
2009/0252611 A1* 10/2009 Tipton ..... F01D 5/326 416/220 R
2009/0297351 A1 12/2009 Brahmasuraih
2012/0177498 A1* 7/2012 Yarava ..... F01D 5/323 416/220 R
2013/0051947 A1* 2/2013 Holmes ..... B23B 41/00 408/103
2013/0216387 A1* 8/2013 Torkaman ..... F01D 5/323 416/220 R
2016/0305259 A1* 10/2016 Evans ..... F01D 5/3007
2017/0198592 A1 7/2017 Colletti et al.

OTHER PUBLICATIONS

Extended European Search Report and Opinion issued in connection with corresponding EP Application No. 17184781.7 dated Dec. 8, 2017.

* cited by examiner

GAS TURBINE WHEEL ASSEMBLY, METHOD OF MODIFYING A COMPRESSOR WHEEL, AND METHOD OF MOUNTING A BLADE TO A GAS TURBINE WHEEL

FIELD OF THE INVENTION

The present embodiments are directed to axial compressors. More specifically, the present embodiments are directed to methods of modifying a compressor wheel, methods of mounting a blade to a compressor wheel, and compressor wheel assemblies.

BACKGROUND OF THE INVENTION

Gas turbine systems generally include an axial compressor including compressor wheels and having a number of stages. Working fluid flowing into the axial compressor is compressed at each stage. The working fluid flows in a direction generally parallel to the axis of rotation of the axial compressor. Each stage includes blades mounted to a rim of a rotatable compressor wheel in a spaced relationship. Each blade has an airfoil and a base. The base is held in an axially-oriented slot in the compressor wheel. A typical compressor wheel may have dozens of blades mounted thereon.

The base of each blade may have a dovetailed portion that is received by and interlocks with a dovetail-shaped axially-oriented slot along the rim of the compressor wheel to secure the blade to the compressor wheel. The blade dovetails may be secured to the compressor wheel by a process called staking, where material at the edge of the compressor wheel slot is plastically deformed and displaced into a void created by a local chamfer of the blade dovetail. The radial faces of compressor wheel dovetails are staked in order to axially retain the blades in the radial slots. Specifically, each blade may be placed within an axial slot in the rim and then staked into place at both ends by deforming the metal material around the blade dovetail with a tool that conventionally is similar to a nail punch. This process is repeated for each blade for each wheel assembly stage. Staking economically and mechanically secures a blade or other attachment to the slot in the compressor wheel or other type of wheel.

In an inspection or an overhaul process, the blades may be removed from the compressor wheel and the original stakes may be ground out. There are a finite number of attachments due to a limited number of viable staking locations about the compressor wheel. After several airfoil swap-outs, these areas are covered in old stake marks with no room for new ones. As such, the compressor wheel generally must be replaced once these staking locations have been consumed, even if the compressor wheel is otherwise still operable.

BRIEF DESCRIPTION OF THE INVENTION

In an embodiment, a method of modifying a compressor wheel includes forming a stake-receiving feature having a reconditioned surface on a radial face of an axial slot in a rim of the compressor wheel. The forming includes removing material from the compressor wheel to remove a plurality of stake marks in the radial face.

In another embodiment, a gas turbine wheel assembly includes a gas turbine wheel rotatable about an axis of a turbine and a plurality of blades. The gas turbine wheel has a plurality of axial slots. Each axial slot has a radial face. At least one radial face of at least one axial slot includes a stake-receiving feature having a reconditioned surface. Each blade includes a base and an airfoil extending from the base. Each blade is received in one of the axial slots. Material displaced at the reconditioned surface of the stake-receiving feature by staking axially retains the blades in the axial slot.

In another embodiment, a method of mounting a blade to a gas turbine wheel includes inserting a base of the blade into an axial slot of the gas turbine wheel and staking the base of the blade in the axial slot by displacing material at a reconditioned surface of a stake-receiving feature on a radial face of the axial slot to axially retain the base of the blade in the axial slot.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

Provided is a method of modifying a compressor wheel, a gas turbine wheel assembly, and a method of mounting a blade to a gas turbine wheel.

Embodiments of the present disclosure, for example, in comparison to concepts failing to include one or more of the features disclosed herein, extend the lifespan of a gas turbine wheel, provide a reconditioned surface for staking the gas turbine wheel to a blade, permit additional staking operations during the lifespan of a gas turbine wheel, solve the problem of loss of retention area that occurs with repetitive staking, reduce or eliminate the need for rim staking, which is a risky operation due to the proximity to the airfoil base fillet, save a gas turbine wheel from otherwise becoming scrapped, provide a rough cut and/or a skim cut to a radial face of a gas turbine wheel, or combinations thereof.

Staking, as used herein, refers to any process that creates a region of plastically deformed metal such that component retention is possible.

A reconditioned surface, as used herein, refers to a fresh surface that has not been exposed to operational conditions, as opposed to an in-service surface that has been exposed to operational conditions.

A skim cut, as used herein, refers to a thin cut to remove a relatively small amount of material at a surface, preferably to provide a reconditioned surface with a better finish and a closer tolerance to a desired surface shape relative to a fresh surface after a rough cut.

Figure 1:
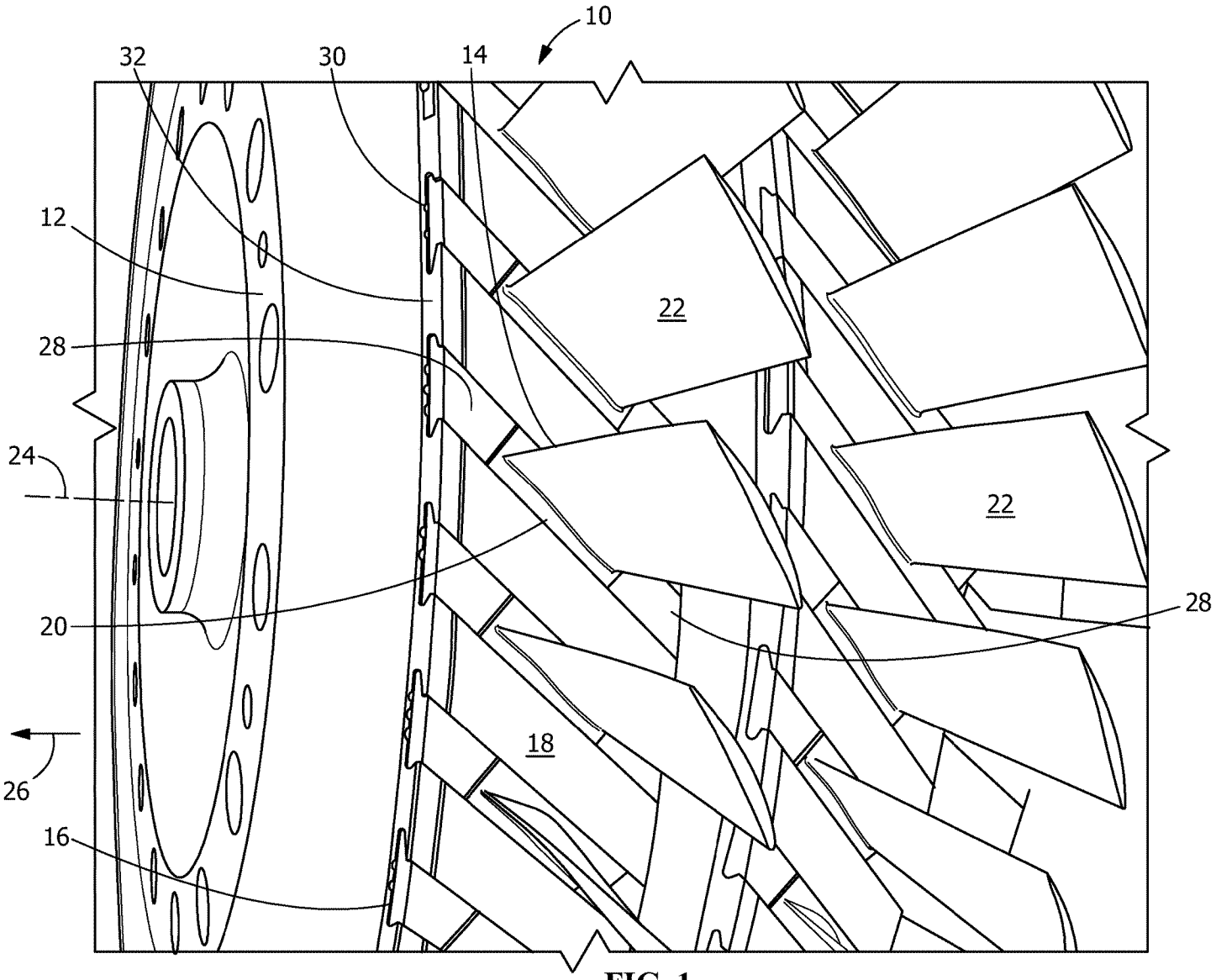
FIG. 1 is a perspective view of two gas turbine wheels with blades staked in the axial slots.
Figure 2:
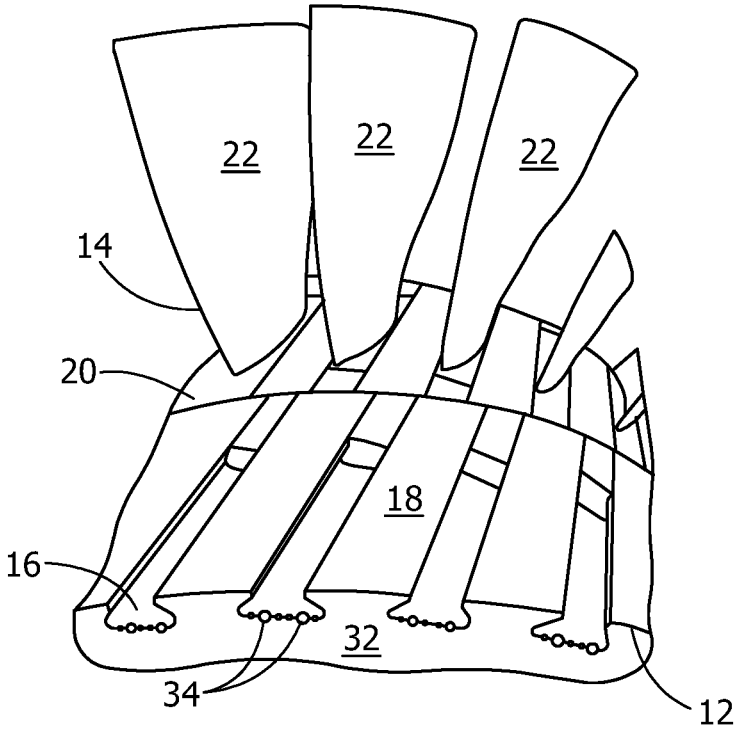
FIG. 2 is a schematic axial view of a portion of the rims of two gas turbine wheels.

Referring to FIG. 1, a gas turbine wheel assembly 10 includes a gas turbine wheel 12 and blades 14 mounted in axial slots 16 on the rim 18 of the gas turbine wheel 12. The gas turbine wheel 12 may be any wheel of a gas turbine. In some embodiments, the gas turbine wheel 12 is a compressor wheel. Each blade 14 includes a base 20 retained in the axial slot 16 and an airfoil 22 extending radially from the base 20. The compressor wheel is rotatable about a central axis 24 in an axial compressor to drive and compress a working fluid with the airfoils 22 of the blades 14, where the working fluid travels generally in an axial direction 26. Although the axial slots 16 generally extend in the axial direction 26, they may be slightly angled around the rim 18 of the gas turbine wheel 12, as shown in FIG. 1 and FIG. 2. The base 20 of each blade 14 is flanked on either side by a spacer 28 in the axial slot 16 and is staked on both ends of the axial slot 16 by material 30 from the radial face 32 of the axial slot 16 to retain the base 24 of the blade 14 axially in the axial slot 16. The material 30 extends into the axial slot 16 to limit or prevent axial movement of the base 20 in the axial slot 16. The staking forms stake marks 34 (see FIG. 2) in the axial slot 16. A dovetail shape 36 (see FIG. 3) of the base 24 and axial slot 16 retains the base 24 radially in the axial slot 16.

Figure 3:
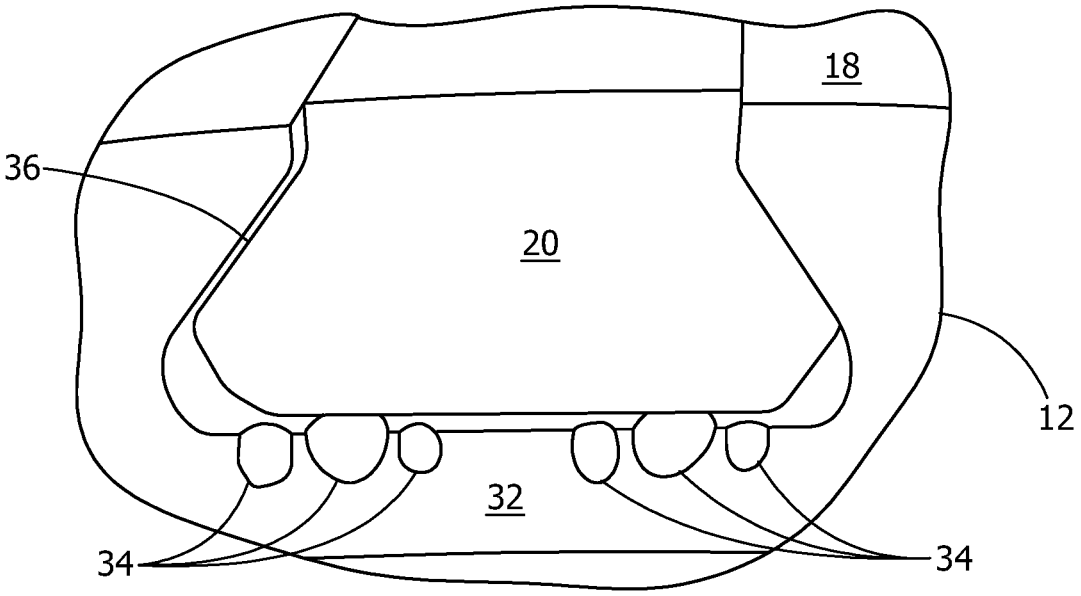
FIG. 3 is an end view of an axial slot and a dovetail-shaped base.

Referring to FIG. 2, in order to remove a blade 22 from the gas turbine wheel 12 for repair or replacement during a servicing period, the material 30 (see FIG. 1) extending into the axial slot 16 must be removed. The removal of the material 30 leaves behind stake marks 34 in the radial face 32 of the axial slot 16. The removal of the material 30 may be accomplished by any suitable method, including, but not limited to, blending, grinding away the material 30, filing away the material 30, or any combination thereof. After repetitive cycles of staking and removal, the radial face 32 of the axial slot 16 no longer has enough material 30 to permit additional staking of the radial face 32, as shown in FIG. 3.

Figure 4:
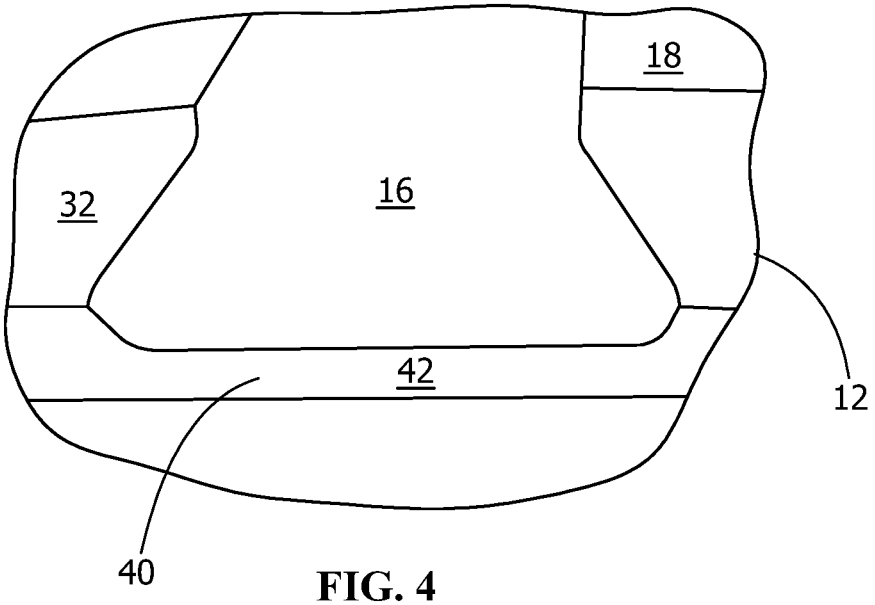
FIG. 4 shows the end view of FIG. 3 after modification of the gas turbine wheel, according to an embodiment of the present disclosure.
Figure 5:
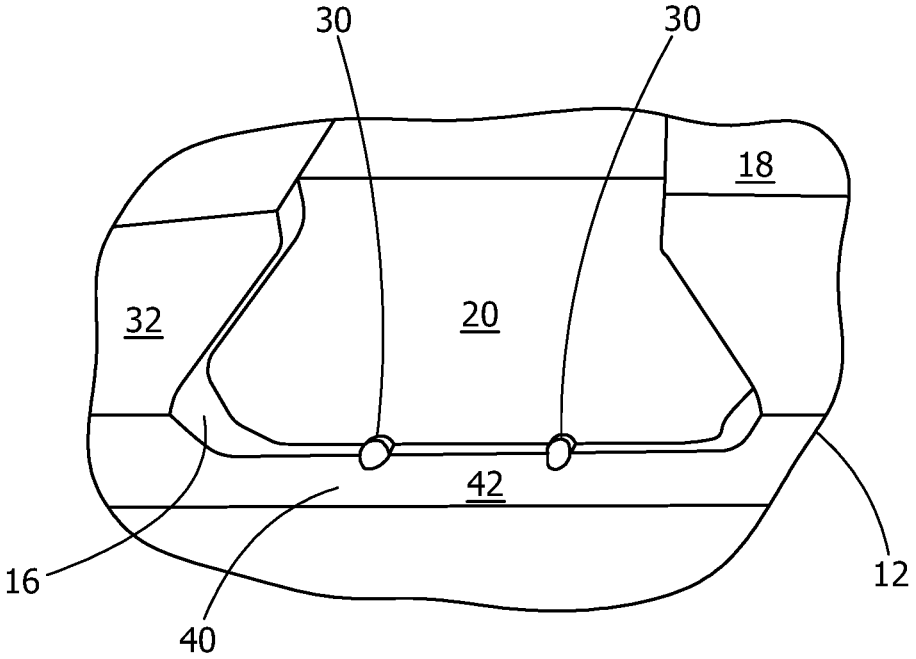
FIG. 5 shows the end view of FIG. 4 after staking, according to an embodiment of the present disclosure.

Referring to FIG. 4, when the radial face 32 no longer has sufficient material 30 for additional staking, the gas turbine wheel 12 is preferably modified to provide a stake-receiving feature 40 having a reconditioned surface 42 with additional material for staking. As a result of service time in an operating turbine, the remainder of the radial face 32 may be an in-service surface that has been exposed to operational conditions and may be unmodified to remain in that state. In some embodiments, the number of axial slots 16 no longer having sufficient material on the radial face 32 is sufficient enough to justify removal of an annulus of material from the radial face 32 around the whole rim 18 of the gas turbine wheel 12. The reconditioned surface 42 preferably angles toward the central axis 24 (see FIG. 1), as shown in FIG. 4. FIG. 5 shows that the reconditioned surface 42 of the stake-receiving feature 40 of FIG. 4 has been staked to displace new material 30 to maintain the base 20 in the axial slot 16. In some embodiments, mounting a blade 14 to the gas turbine wheel 12 includes inserting the base 20 of the blade 14 into the axial slot 16 of the gas turbine wheel 12 and staking the gas turbine wheel 12 to the base 20 of the blade 14 in the axial slot 16 by displacing material 30 at the reconditioned surface 42 of the stake-receiving feature 40 on the radial face 32 of the axial slot 16 to axially retain the base 20 of the blade 14 in the axial slot 16.

Figure 6:
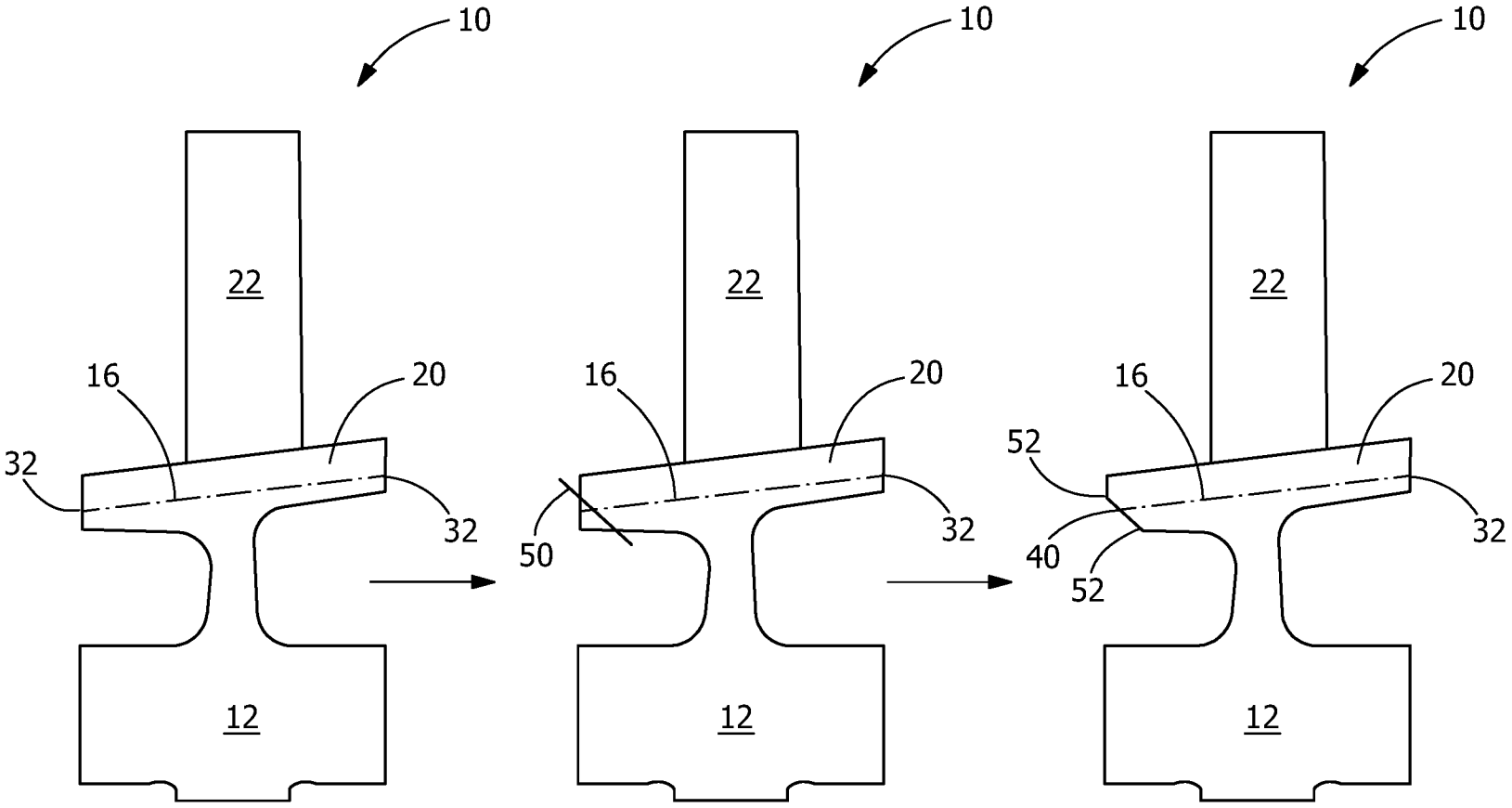
FIG. 6 shows a method of modifying a gas turbine wheel to form a reconditioned surface having a chamfer contour, according to an embodiment of the present disclosure.

The stake-receiving feature 40 may be formed to have any contour that provides a reconditioned surface 42 without stake marks 34. Referring to FIG. 6, a schematic side view of a gas turbine wheel assembly 10 shows a gas turbine wheel 12 at various stages of a method of modification. In the left gas turbine wheel assembly 10, the gas turbine wheel 12 includes stake marks 34 (not shown, see FIG. 2) in at least one of the two radial faces 32 of the axial slot 16. The base 20 and the airfoil 22 are shown in the axial slot 16 for reference. In the middle gas turbine wheel assembly 10, a contour line 50 for a rough cut to remove the stake marks 34 and part of the radial face 32 is selected. In this embodiment, the contour line 50 is a chamfer. In the right gas turbine wheel assembly 10 of FIG. 6, a rough cut followed by a skim cut along the contour line 50 with endpoints 52, where one endpoint 52 is an initiation point and the other endpoint 52 is a termination point, produces the stake-receiving feature 40.

Figure 7:
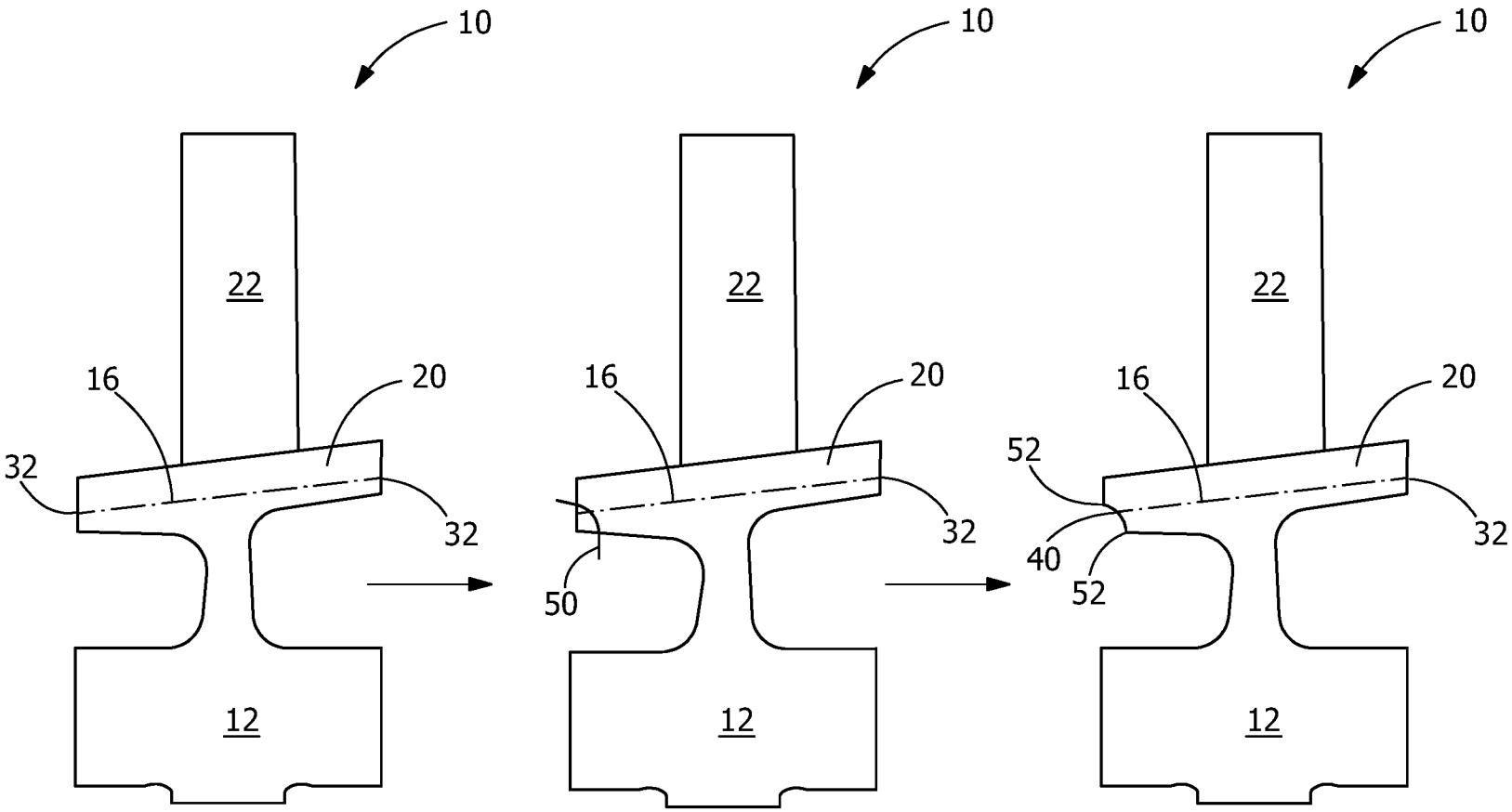
FIG. 7 shows a method of modifying a gas turbine wheel to form a reconditioned surface having a round-over contour, according to an embodiment of the present disclosure.

Referring to FIG. 7, a schematic side view of a gas turbine wheel assembly 10 shows a gas turbine wheel 12 at various stages of a method of modification. In the left gas turbine wheel assembly 10, the gas turbine wheel 12 includes stake marks 34 (not shown, see FIG. 2) in at least one of the two radial faces 32 of the axial slot 16. The base 20 and the airfoil 22 are shown in the axial slot 16 for reference. In the middle gas turbine wheel assembly 10, a contour line 50 for a rough cut to remove the stake marks 34 and part of the radial face 32 is selected. In this embodiment, the contour line 50 is a round-over. In the right gas turbine wheel assembly 10 of FIG. 7, a rough cut followed by a skim cut along the contour line 50 with endpoints 52, where one endpoint 52 is an initiation point and the other endpoint 52 is a termination point, produces the stake-receiving feature 40.

Figure 8:
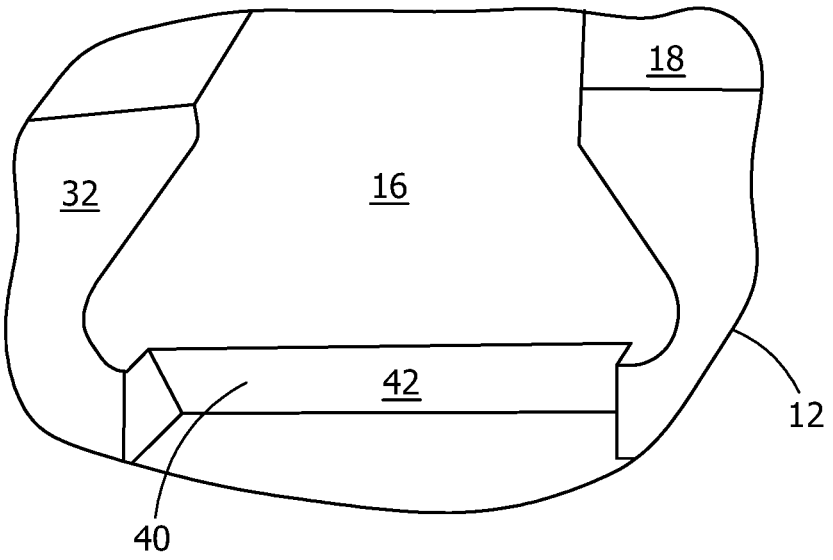
FIG. 8 shows the end view of FIG. 3 after modification of the gas turbine wheel, according to an embodiment of the present disclosure.
Figure 9:
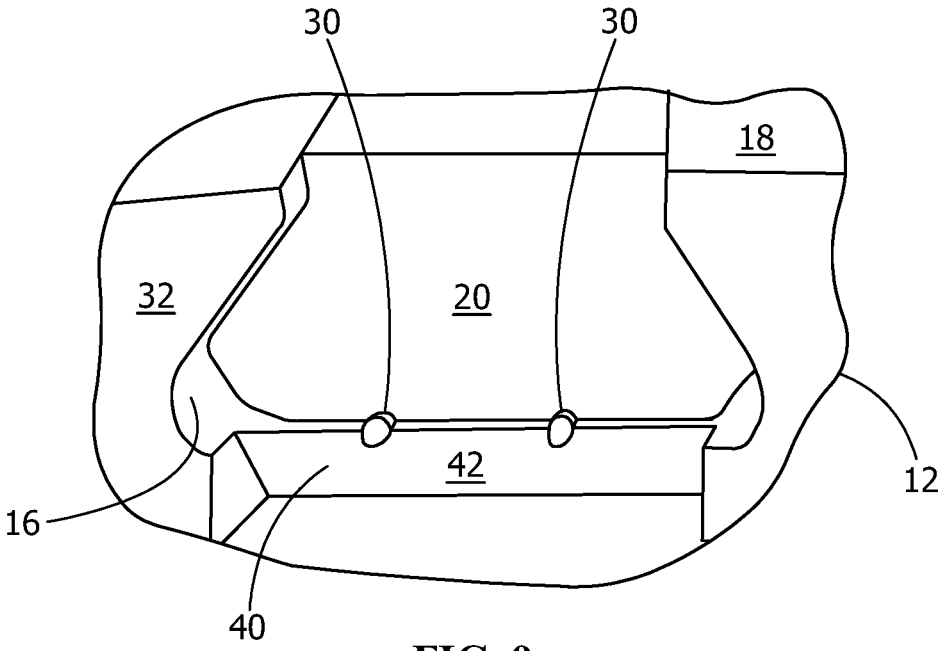
FIG. 9 shows the end view of FIG. 8 after staking, according to an embodiment of the present disclosure.

In some embodiments, only one or a very small number of axial slots 16 on the gas turbine wheel 12 have a radial face 32 that no longer has sufficient material 30 for additional staking. In such embodiments, the gas turbine wheel 12 may be modified to provide a stake-receiving feature 40 having a reconditioned surface 42 with additional material for staking to only those axial slots 16 in need thereof, one such modified axial slot 16 being shown in FIG. 8. In some embodiments, the reconditioned surface 42 may angle toward the central axis 24 (see FIG. 1), as shown in FIG. 8, with a chamfer or round-over contour. In other embodiments, the reconditioned surface 42 of the stake-receiving feature 40 may be substantially parallel to the radial face 32 of the gas turbine wheel 12 and/or substantially perpendicular to the axial direction 26. In yet other embodiments, the reconditioned surface 42 may angle away from the central axis 24 with a straight, concave, or convex contour. FIG. 9 shows that the reconditioned surface 42 of the stake-receiving feature 40 of FIG. 8 has been staked to displace new material 30 to maintain the base 20 in the axial slot 16.

In some embodiments, the process cuts a chamfer or round-over feature into the radial face 32 of the gas turbine wheel 12 to expose virgin metal for stakes. In some embodiments, the cut dimensions are selected and analyzed such that there is no life debit or increase in dovetail 36 stress as a result of the cut. This cut creates new room for retention stakes on the gas turbine wheel 12, but it may be difficult to select initiation and termination endpoints 52 for the cut, as this procedure may have the propensity to increase local stress in the gas turbine wheel 12 and blade 14 dovetail 36. Special care is preferably taken to find endpoint 52 locations where this effect is minimized.

Since the modification to the gas turbine wheel 12 effectively may decrease the length of the axial slot 16, it may be necessary to replace the blade 14 and/or one or both of the spacers 28 with a shorter version or to machine the base 20 and/or one or both of the spacers 28 to provide an assembly having a total length to accommodate the decreased length of the axial slot 16.

In some embodiments, the shape and location of the stake-receiving feature 40 may be selected to minimize local stress in the gas turbine wheel. The machining operation itself is preferably simple. In some embodiments, a rough cut is followed by a skim cut. In some embodiments, only a series of skim cuts may be needed. In some embodiments, only a single skim cut may be needed. The rough cut and/or the skim cut may be performed by any appropriate cutting device, including, but not limited to, a lathe, a mill, a hand plane, a hand tool, a hand grinder, a machine grinder, a saw, a hand file, or any combination thereof. The cutting and staking are preferably performed without introducing a crack and/or any other unintended defect in the gas turbine wheel 12 that may otherwise reduce or lessen the operational lifespan of the gas turbine wheel 12.

Although the gas turbine wheel 12 is shown as staked to the base 20 of the blade 14 in the figures, the base 20 may be alternatively staked to the gas turbine wheel 12. In such embodiments, the radial face of the base 20 may be deformed to displace material and prevent or limit axial movement of the base 20 in the axial slot 16. In such embodiments, a portion of the radial face of the base 20 may be removed along with stake marks in the radial face to provide a stake-receiving feature having a reconditioned surface. This stake-receiving feature may have any appropriate contour, such as any contours similar to the stake-receiving feature 40 of a modified gas turbine wheel 12.

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. A method of modifying a compressor wheel comprising:

providing the compressor wheel comprising a rim having a radial face of an axial slot, the compressor wheel having a plurality of stake marks in the radial face of the axial slot, the plurality of stake marks having been formed by staking; and then removing first material from the radial face of the compressor wheel, wherein the removing includes removing the plurality of stake marks in the radial face to expose virgin material at a reconditioned surface, thereby forming a stake-receiving feature in the radial face of the compressor wheel, the stake-receiving feature having the reconditioned surface without stake marks on the radial face, and the stake-receiving feature having the virgin material of the compressor wheel for staking the compressor wheel to a base of a blade in the axial slot by displacing the virgin material at the reconditioned surface of the stake-receiving feature and forming stake marks in the reconditioned surface of the compressor wheel to retain the base of the blade in the axial slot.

2. The method of claim 1, wherein the removing and forming comprises making a rough cut in the radial face of the axial slot followed by making a skim cut in the radial face that decrease a length of the axial slot.

3. The method of claim 1, wherein the reconditioned surface has a chamfer contour.

4. The method of claim 1, wherein the reconditioned surface has a round-over contour.

5. The method of claim 1, wherein the stake-receiving feature is provided at a stake location along the radial face.

6. The method of claim 1 further comprising selecting an initiation point and a termination point for the removing to minimize local stress in the compressor wheel when the blade is staked in the axial slot by a fresh mark in the stake-receiving feature.

7. The method of claim 1 further comprising inserting the base of the blade into the axial slot.

8. The method of claim 7 further comprising staking the base of the blade in the axial slot by displacing the virgin material at the reconditioned surface of the stake-receiving feature.

9. The method of claim 8, wherein the staking axially retains the base of the blade in the axial slot.

10. The method of claim 1, wherein the axial slot is contoured to receive the base of the blade having a dovetail contour.

11. A gas turbine wheel assembly comprising:

a gas turbine wheel rotatable about an axis of a turbine, the gas turbine wheel having a plurality of axial slots, each axial slot having a radial face, at least one radial face of at least one of the plurality of axial slots comprising a stake-receiving feature of virgin material of the gas turbine wheel, the stake-receiving feature of the gas turbine wheel having been formed by removal of first material from the radial face of the gas turbine wheel and having a reconditioned surface of the virgin material for staking, a remainder of the radial face having an in-service surface, the in-service surface having been exposed to operational conditions; and a plurality of blades, each blade comprising a base and an airfoil extending from the base, each blade being received in one of the plurality of axial slots;

wherein the virgin material, displaced at the reconditioned surface of the stake-receiving feature of the gas turbine wheel by staking, forming stake marks in the reconditioned surface of the virgin material of the gas turbine wheel, stakes the gas turbine wheel to the base of one of the plurality of blades in the at least one axial slot and axially retains the one of the plurality of blades in the at least one axial slot;

wherein the reconditioned surface of the radial face is without stake marks prior to the staking.

12. The gas turbine wheel assembly of claim 11, wherein the reconditioned surface has a surface contour selected from the group consisting of a chamfer contour and a round-over contour.

13. The gas turbine wheel assembly of claim 11, wherein the bases of the plurality of blades have a dovetail contour.

14. A method of mounting a blade to a gas turbine wheel, the method comprising:

inserting a base of the blade into an axial slot of the gas turbine wheel; and staking the gas turbine wheel to the base of the blade in the axial slot by displacing virgin material of the gas turbine wheel, the virgin material of the gas turbine wheel providing a stake-receiving feature of a radial face of the axial slot of the gas turbine wheel, the stake-receiving feature having been formed by removal of first material from the radial face of the gas turbine wheel, to axially retain the base of the blade in the axial slot, the staking forming stake marks in a reconditioned surface of the virgin material of the gas turbine wheel, a remainder of the radial face having an in-service surface, the in-service surface having been exposed to operational conditions;

wherein the reconditioned surface of the radial face is without stake marks prior to the staking.

15. The method of claim 14 further comprising removing material from the radial face of the gas turbine wheel to remove a plurality of stake marks in the radial face and to form the stake-receiving feature of the radial face.

16. The method of claim 15, wherein the removing comprises making a rough cut in the radial face followed by making a skim cut in the radial face that decrease a length of the axial slot.

17. The method of claim 15 further comprising selecting an initiation point and a termination point for the removing to minimize local stress in the gas turbine wheel when the blade is staked in the axial slot.

18. The method of claim 14, wherein the reconditioned surface has a chamfer contour.

19. The method of claim 14, wherein the reconditioned surface has a round-over contour.

20. The method of claim 14, wherein the base of the blade has a dovetail contour.

* * * * *